US005943960A

United States Patent [19]

Becker et al.

[11] Patent Number: 5,943,960

[45] Date of Patent: Aug. 31, 1999

[54] RUNNING WHEEL BLOCK

[75] Inventors: Eberhard Becker, Hagen; Udo Gersemsky, Herdecke; Winfried Gievers, Wetter; Klaus-Peter Hoffmann, Schwerte; Karl Liebig, Wetter; Bernd Neupert, Wetter; Hans-Hermann Osthoff, Wetter; Thomas Schweflinghaus, Wuppertal; Roland Staggl, Wetter; Karl Zacharias, Schwerte, all of Germany

[73] Assignee: Mannesmann AG, Düsseldorf, Germany

[21] Appl. No.: 09/063,264

[22] Filed: Apr. 20, 1998

Related U.S. Application Data

[63] Continuation of application No. PCT/DE96/02023, Oct. 18, 1996.

[30] Foreign Application Priority Data

| | | | |
|---|---|---|---|
| Oct. 18, 1995 | [DE] | Germany | 195 40 220 |
| Oct. 18, 1995 | [DE] | Germany | 195 40 215 |
| Oct. 18, 1995 | [DE] | Germany | 195 40 216 |
| Oct. 18, 1995 | [DE] | Germany | 195 40 217 |
| Oct. 18, 1995 | [DE] | Germany | 195 40 219 |

[51] Int. Cl.[6] ..... B61D 1/00

[52] U.S. Cl. ..... 105/180; 105/220

[58] Field of Search ..... 105/180, 218.1, 105/220, 148, 150; 301/1, 111, 114, 124.1; 295/36.1, 42, 42.1, 43

[56] References Cited

U.S. PATENT DOCUMENTS

| | | | |
|---|---|---|---|
| 2,521,660 | 9/1950 | Westover | 105/180 |
| 3,049,083 | 8/1962 | Potter et al. | 105/180 |
| 4,385,562 | 5/1983 | Bitsch et al. | 105/163.1 |
| 4,550,664 | 11/1985 | Bitsch et al. | 105/180 |
| 5,005,912 | 4/1991 | Pipes | 301/111 |
| 5,209,167 | 5/1993 | Donner et al. | 105/180 |

*Primary Examiner*—Lee W. Young
*Assistant Examiner*—Pam Lipka
*Attorney, Agent, or Firm*—Cohen, Pontani, Lieberman & Pavane

[57] ABSTRACT

A running wheel block, including a housing having at least one connecting surface for connection to a supporting framework, and further having two opposing, detachable side walls, two inwardly directed rotary bearing holding hubs, arranged in the housing, rotary bearings mounted in the hubs, and a running wheel mounted in the rotary bearings so that a section of its running surface projects from the housing toward at least one side. Each of the holding hubs is arranged on one of the two opposing side walls of the housing. The housing further includes at least one spacing holder arranged between the opposing side walls. The spacing holder forms a connecting surface. The detachable side wall has centering members that, when the side wall is attached to the housing, determine the position of the holding hubs relative to the running wheel axis.

20 Claims, 7 Drawing Sheets

RUNNING WHEEL BLOCK

This is a Continuation Application under 35 U.S.C. §111 and 37 C.F.R. §1.53 of International PCT Application No. PCT/DE96/02023 which was field on Oct. 18,1996, published as Publication No. WO 97/14645 on Apr. 24,1997, and claims priority from GERMAN APPLICATIONS NOS. 195 40 220.0; 195 40 215.4; 195 40 216.2; 195 40 217.0 and 195 40 219.7 all filed on Oct. 18, 1995

BACKGROUND OF THE INVENTION

1. Field of the Invention

The invention relates to a running wheel block with a housing with at least one connecting surface.

2. Discussion of the Prior Art

A running wheel block of this type is known from German reference DE 31 34 750 C2. This known running wheel block is composed of two halves of the bearing housing, which are welded together or otherwise connected to each other, and has inwardly pressed pivot bearing seats for bearings that support the hub of the running wheel. Attached to the pivot bearing seats are stop faces for the bearings, which stop faces are directed toward the hub. The hub of the running wheel extends over the bearings and rests directly over them on the housing. The housing, on its outer rings on both sides, has ring grooves for snap rings located on the bearing fronts, and also has a holding hole with internal toothing for the external toothing of a drive shaft. This design has been in successful use for years. However, the need to minimize costs and improve function still exists.

In the known running wheel block, it is disadvantageous that, to exchange the running wheel, the running wheel block in its entirety must be completely removed from the supporting framework.

After the running wheel is exchanged, the entire running wheel block is reattached to the supporting framework, exactly as during the initial assembly, by means of screws. For this purpose, the position of the running wheel block, relative to the supporting framework with the other running wheels, must be oriented so that the rotational axis of the running wheel runs at a right angle to the path on which the running wheel rolls. Due to this complicated orientation procedure, assembly is time-consuming and, because of the lengthened down time, cost intensive. If the orientation procedure is not carried out, the danger exists that the running wheels will abrade as the result of skewed running on their path and will thus become worn more quickly. Further, when the application involves a bridge crane, the danger exists that the performance of the sensitive bridge crane will be disrupted by skewed running, canting or wheel flange wear. In addition, as the skewed running angle increases, lateral forces arise, which place stress, in addition to the operating stress, on the supporting framework or the like.

Further, French Reference FR A 2667543 describes a running wheel block with a housing that consists of two housing halves, which jointly form the connecting surface on one side of the one housing. To exchange parts subject to wear, this running wheel block must also be completely removed from the supporting framework and disassembled. Thus, after reattachment of the running wheel block, a new orientation and adjustment procedure is required.

SUMMARY OF THE INVENTION

Accordingly, it is an object of the present invention to provide a running wheel block in which it is possible to exchange parts subject to wear without removing the running wheel block from the supporting framework. In addition, manufacturing and assembly costs are to be minimized by a further embodiment of a running wheel block, and customer benefits are thus to be increased.

Pursuant to this object, and others which will become apparent hereafter, one aspect of the present invention resides in each of two provided holding hubs being arranged on one of two opposite side walls, which is detachable in the installed state, and between which side walls there is at least one spacing holder that, together with the side walls, forms the housing, on which spacing holder the connecting surface is embodied. The detachable side wall is equipped with centering means that, when the side wall is attached to the housing, determine the position of the holding hub relative to the running wheel axis. Moreover, two separate spacing holders are arranged, seen in the direction of travel, in front of and behind the running wheel.

It is thus proposed that the running wheel block have a housing with at least one connecting surface for connection to a supporting framework, and that this housing need not be completely removed to exchange parts subject to wear, so that the housing remains attached to the supporting framework in a substantially oriented fashion. To exchange the parts subject to wear, the inwardly directed holding hubs for the rotary bearing of the running wheel are arranged and embodied so that the parts subject to wear can be removed from an openly embodied housing side and then reinstalled without the running wheel block having to be readjusted at the end.

In this solution, the detachable side walls and the spacing holder or spacing holders form the housing, whereby the substantially massive spacing holder has the required connecting surface. The side walls are each equipped with a holding hub. It is thus possible to detach a part of the housing, namely, at least one side wall, and then to remove parts subject to wear. Vice versa, such parts can be reinstalled while maintaining the original installed state of the running wheel block, whereby the centering means, when the side wall is attached, serve to determine the position of the holding hub relative to the running wheel axis. In addition, this solution has the advantage that the housing width can be simply varied by means of spacing holders of different widths, particularly when different running wheel widths are provided.

It is further proposed that the housing be composed of bilaterally arranged side walls and of at least one spacing holder, which connects the two side walls to a circumferential section and has a head connecting surface that absorbs the carrying force. On the head connecting surface, which extends to the housing width or the running wheel width, there are connecting means for a supporting framework, carrier, travelling frame or the like. Further, the side walls bilaterally carry, on or in side wall hubs, rotary bearings that terminate approximately with the width of the running wheel or a running wheel hub. The present invention permits the running wheel and/or bearing to be exchanged without the housing having to be detached from the supporting framework. As a result, the time-consuming and cost-intensive orientation procedure following the exchange of parts subject to wear is dispensed with. The housing can continue in use and remains oriented on the supporting framework or the like as long as desired. Further, there is the advantage that in addition to detachable connecting means, it is also possible to use non-detachable connecting means, because the block-type housing no longer needs to be removed from its carrier or travelling frame. Further advantages result from the fact that the side walls as well as the spacing holders can be produced as economical mass goods, so that, given suitably high piece numbers, the cost of individual pieces can be considerably reduced. It is also advantageous that the newly developed running wheel block can be broken down completely into its parts and recycled. This is especially advantageous in view of rising waste disposal costs and disposal according to material.

In another embodiment of the invention, two separated spacing holders are arranged, seen in the direction of travel, in front of and behind the running wheel. The pieces in question are relatively light pieces with planar-parallel side surfaces, and can be correspondingly advantageously manufactured.

According to a further embodiment, an opening that arises when spacing holders are used can be closed by means of a closing piece. As a result, even smaller spacing holders, which consume less material, can be created. Further, the closing pieces do not need to be manufactured from the same material as the housing, because they do not absorb carrying forces and need not have the same stress capacity. The closing pieces prevent the penetration of dirt or other impurities, even in the event of the open side of the housing, from which the running wheel projects, is directed in the gravitational direction (i.e., is directed downward).

In a further embodiment of the invention, the spacing holder is produced from an extruded profile. For the most part, post-working of the spacing holders can be omitted, so that only one work step is needed to establish the thickness of the spacing holder on the extended extruded profile.

The choice of a spacing holder created from an extruded profile results in further advantages, in that the spacing holder is embodied for different running wheel widths with a corresponding width. Here, too, only a single thickness setting is required when the spacing holder is cut.

In addition, it is possible for an adjustment to different running wheel diameters and carrying forces to be made, in that, given a narrow embodiment of the running wheel, the two side wall hubs run toward each other up to a distancing gap.

Because the side wall can be produced by casting, extrusion and similar hot or cold deformation processes, it is still possible for the cross-section of the side wall to be made thicker outside of the running wheel diameter. Accordingly, it is possible to locate components in the thicker areas. It is thereby advantageous for sinks for screw heads and nuts to be arranged in the thicker cross-section of the side wall. The sinks can be hexagonal in shape, and alternately can hold either an inner hexagonal head or a hexagonal nut.

It is also advantageous with respect to manufacturing technology that the two side walls are embodied identically. As a result, a cost reduction is also attained through the number of side walls to be produced.

A projection of the running wheel upward or downward is made possible by the fact that intermediate pieces are provided to serve as the spacing holders, which intermediate pieces laterally fill the space between the two side walls on the circumferential section of the running wheel.

Mounting the running wheel block in conjunction with the adjustment of the individual parts is advantageous, because the intermediate pieces have bores or hubs which respectively engage into hubs or bores in the side walls in a fixing fashion.

According to further features, for the detachable or non-detachable attachment of the running wheel block, the respective intermediate pieces are equipped with at least one recess, which runs parallel to the running wheel axis. This allows prefabricated bolts to be used. This in turn permits the hole pattern of the counterpiece to be imprecise without leading to disadvantages, because the bolts can move in the recess and adjust to the imprecise hole pattern.

The aforementioned recess can also be designed as a channel guide, through bores, or threaded bores. The suitable type of through hole can be selected in accordance with the precision of the connection.

Further advantages result from the fact that channel nuts for connecting screws can be run in the channel guides at a right angle and with little play. This embodiment thus facilitates the connection and orientation between the supporting framework, carrier, travelling frame or the like and the housing of the running wheel block during initial assembly.

According to yet another embodiment, the block-like shape of the running wheel block results from the fact that the intermediate pieces are arranged substantially on the housing front sides, which are formed together with the front sides of the side walls.

The basis for the attachment of the running wheel block to a supporting framework, carrier, travelling frame or the like consists of the intermediate pieces and the connecting means. These can advantageously be produced so that the intermediate pieces have channel guides and bores that are part of the extruded profile.

Easy detachment of the side wall to be removed on one side is ensured by the fact that at least one side wall is placed lower, relative to the head connecting surface.

The same advantage results when one side wall is embodied so as to stand back at least relative to one front connecting surface.

Advantageous force transmission is ensured by the fact that at least one side wall is equipped with centering hubs, which engage into corresponding bores of the housing.

It is further proposed that the side wall hubs have inner bores to hold carrying bolts that run concentric to the side wall hub. This contributes to good force transmission for the purpose of supporting the reaction forces in the housing of the running wheel block.

Assembly, disassembly and adjustment are further favored by the fact that a holding hub, to hold the inner ring or the outer ring of a rotary bearing, is embodied in the spacing holder on the side opposite to a side wall.

For alternative attachment positions of the running wheel block, it is further proposed that at least one partial connecting surface be formed on an outer surface of the spacing holder, which outer surface lies opposite to the head connecting surface. The running wheel block can therefore also be used in a set-on or set-up position.

It is also advantageous that the outer front connecting surfaces of the spacing holder or spacing holders are undivided and that each forms an absorbing surface for carrying forces.

A manufacturing method for the essential parts of the running wheel block calls for the side walls to consist of steel sheet, whereby the sheet thickness is bent inward around the running wheel to the running block center.

The running wheel block is designed to be held together in such a way that screw heads, nuts and sinks for attachment bolts are located under standing-back surfaces and thus stand back behind the outer contour of the running wheel block.

To avoid corrosion and to save weight, it is proposed that the spacing holder and/or the side walls be made of a material processed in a molten state. In particular, light metal materials and plastics can be used.

To ensure that a given component has the desired stress capacity, it is foreseen that the material will consist of a light metal alloy.

It can also be advantageous for the material to be an iron alloy, if such strengths are required.

For economical processing, it can be advantageous for the material to consist of a plastifiable plastic.

In this regard, it can be desirable to attain both adequate strength and low weight in the components. For this purpose, it is proposed that the material be a composite material or form a composite material with other materials.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The drawings show:

FIG. 1OB is an embodiment for the attachment of the running wheel block to a supporting framework, carrier, travelling frame or the like.

DETAILED DESCRIPTION OF THE PREFERRED EMBODIMENTS

Figure 1B:
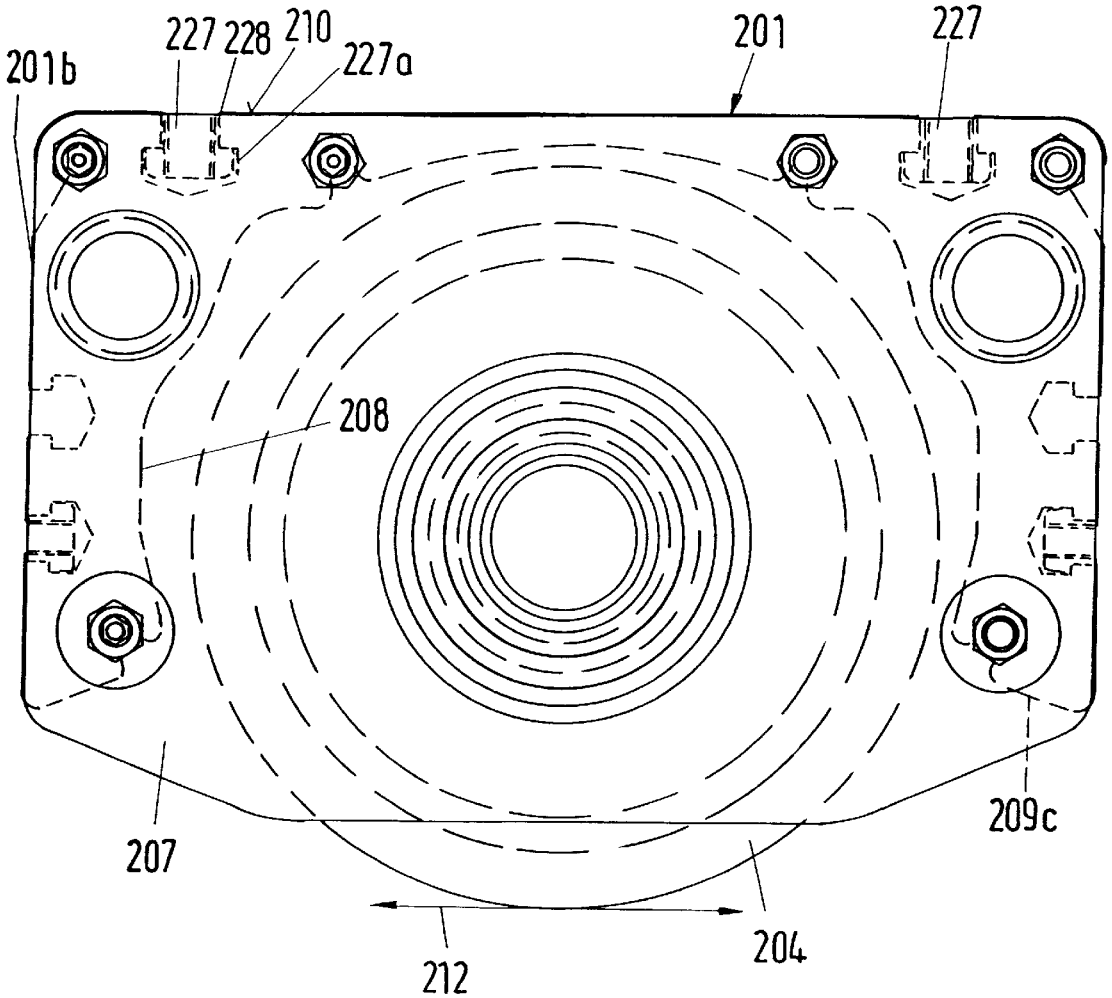
FIG. 1B is a side view of the running wheel block pursuant to the present invention.

A running wheel block (FIGS. 1B and 2B) has a housing 201, in which there are rotary bearing seats 202 (cf. FIG. 3B) for slide and/or roller bearings 203 to accommodate a running wheel 204, which, with a section of its running surface, projects from the housing 201 toward the bottom, i.e., toward one side. For removal of the slide and/or roller bearings 203 and/or the running wheel 204, at least toward one side, the housing 201 can be broken down into its component parts and then reassembled. A carrier or travelling frame 205 (cf. FIGS. 7B to 10B), to which the running wheel block is attached, determines the direction of removal.

The housing 201 is block-shaped, i.e., square, rectangular or trapezoidal when seen from the side, above or below. Its basic form can resemble a cube.

The block-type housing 201 has at least one head connecting surface 210, which absorbs the carrying force of the running wheel 204 and extends roughly to the housing width 201*a* or the running wheel width 204*a*. Connecting means 211 are arranged laterally on the head connecting surface 210 between the housing 201 and the supporting framework, carrier, travelling frame 205 or the like to be connected to the running wheel block.

Arranged in the housing 201 are two inwardly directed holding hubs 206*e*, 207*e*, i.e., the side wall hubs 206*a* and 207*a*, for rotary bearings 203. One side wall hub 206*a* or 207*a* is arranged on a side wall 206 or 207 that can be detached in the installed state, whereby the two side walls 206, 207 lie parallel to each other. Between them there is at least one spacing holder 209 that, together with the side walls 206, 207, forms the housing 201, and at the top of which the head connecting surface 210 is embodied. The detachable side wall 206, 207 is equipped with centering means, such as centering hubs 206*c*, 207*e*, that, when the side wall 206, 207 is attached to the housing 201, determine the position of the holding hub 206*a* or 207*a* relative to the running wheel axis.

Figure 3B:
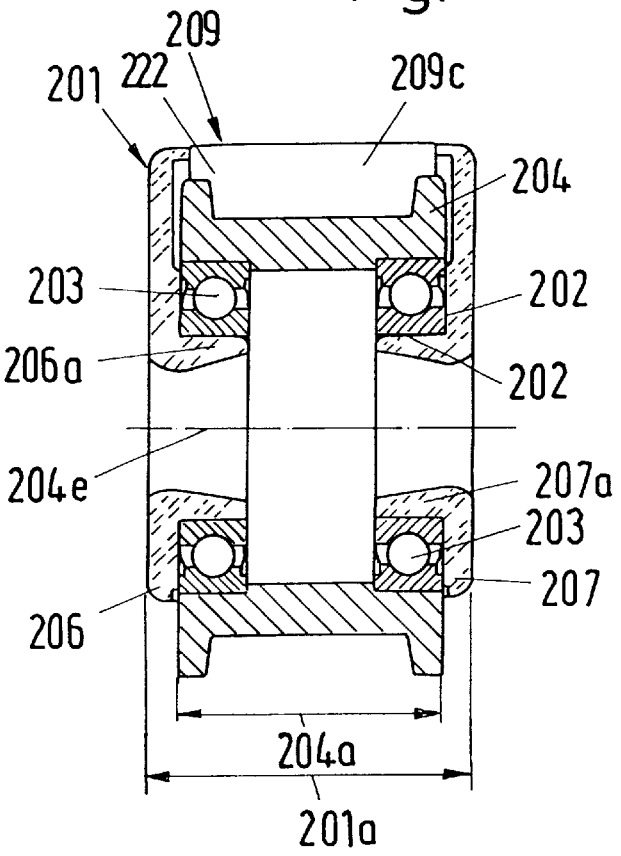
FIG. 3B is an axial vertical cross-section through an embodiment of the running wheel block.
Figure 4B:
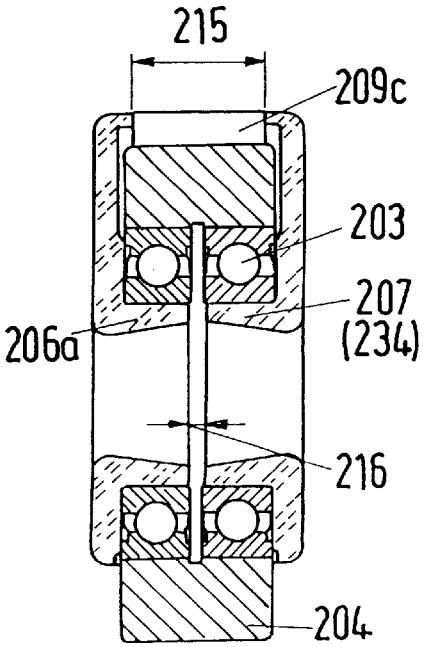
FIG. 4B is an axial vertical cross-section through a different embodiment of the running wheel block.

The housing 201 is thus composed of the bilaterally arranged side walls 206 and 207 and of at least one spacing holder 209, which connects the two side walls 206, 207 to a circumferential section 208 and has the head connecting surface 210. The head connecting surface 210 absorbs the carrying force and extends to the housing width 201*a* or the running wheel width 204*a* (FIG. 3B). On the head connecting surface 210 are provided the connecting means 211 to a supporting framework, carrier, travelling frame 205 or the like. The side walls 206, 207 carry bilaterally, on or in side wall hubs 206*a*, 207*a*, the rotary bearings 203, which terminate approximately with the width 204*a* of the running wheel 204 or a running wheel hub 204*b*.

Figure 2B:
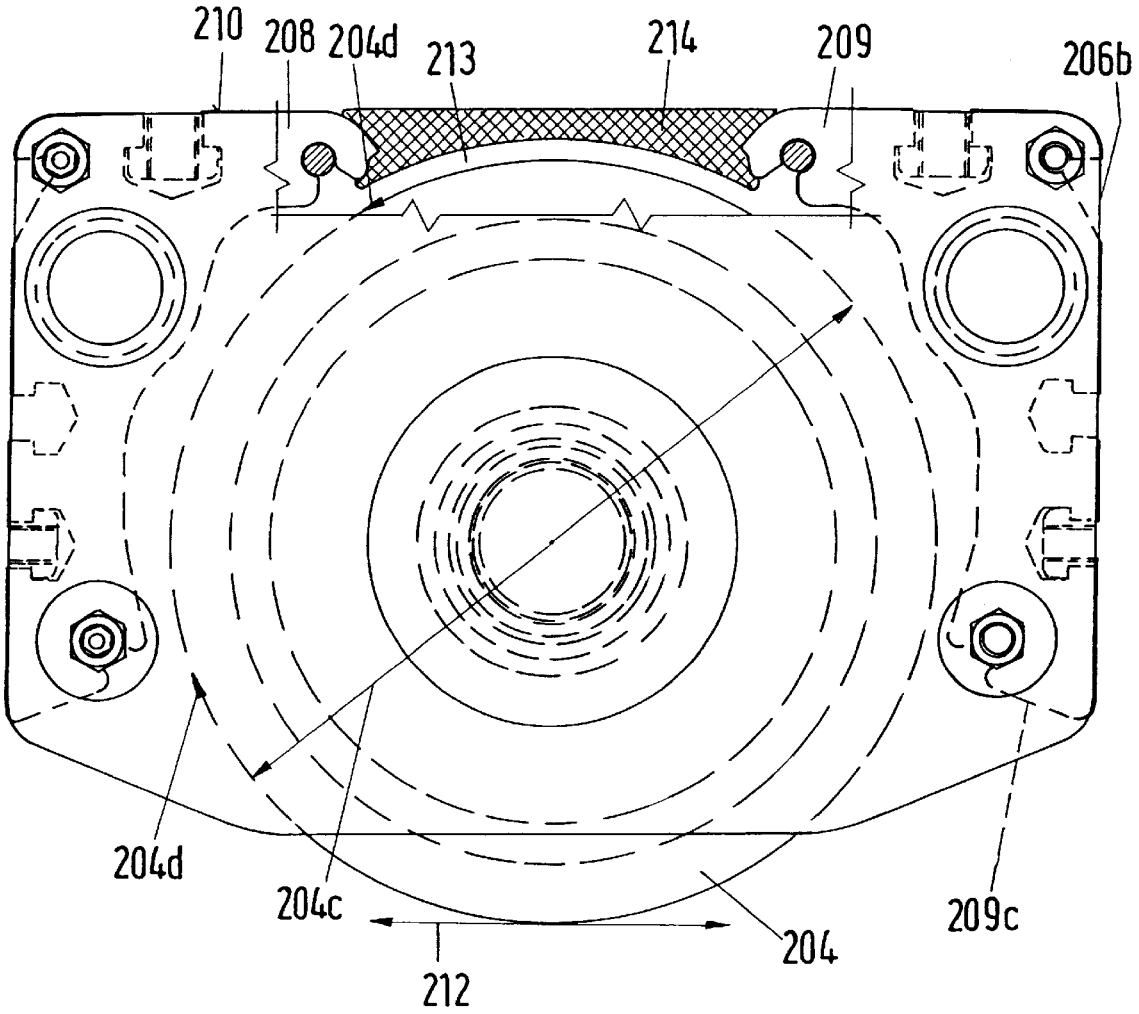
FIG. 2B is the side view as in FIG. 1*b*, partially sectioned.

In the illustrated embodiment, seen in the direction of travel 212, two separated spacing holders 209 are arranged in front of and behind the running wheel 204 (FIGS. 1B and 2B). These are relatively light pieces with planar-parallel side surfaces, which can be accordingly advantageously produced.

When two spacing holders 209 are arranged between the side walls 206 and 207, an opening 213 is created, which can be closed by means of a closing piece 214. The closing piece 214 need not be made from the same material as the side walls or the spacing holders, because it does not absorb carrying forces and need not be of corresponding stress capacity. The closing piece 214 prevents the penetration of contamination or other impurities even in the event that the open side of the housing 201, from which the running wheel projects, points in the direction of gravitation, i.e., downward.

The spacing holder 209 is produced from an extruded profile 209*a*. For the most part, post-working of the spacing holders can be dispensed with, so that only one work step is needed to establish the thickness of the spacing holder on the extended extruded profile. The width of the spacing holder 209 now corresponds to the distance between the support surfaces of the two side walls 206 and 207. The spacing holder 209 can be embodied for different running wheel widths 204*a* with a corresponding width 209*b*, as shown in FIGS. 3B to 5B. It is only necessary to set the thickness of the spacing holder a single time during the cutting process. Given a narrow embodiment 215 of the running wheel 204 or of the spacing holder 209, the two side wall hubs 206*a* and 207*a* run toward each other up to a distancing gap 216

(FIG. 4B), so that adjustments to different running wheel diameters and carrying forces can be made. The cross-section 217 of the side walls 206 and 207 is embodied thicker outside of the running wheel diameter 204*c* (FIG. 6B), so that additional components can be located in the thicker areas. In a thicker cross-section 217*a* of the side wall 206, 207, there are sinks 218 for screw heads 219 and nuts 220. The sinks 218 (FIG. 6B) are hexagonal in shape 221, and alternately hold either an inner hexagonal head 219*a* or a hexagonal nut 221*a*.

The two side walls 206 and 207 are normally embodied identically. To serve as a spacing holder 209, intermediate pieces 209*c* are provided, which laterally fill a space 222 between the two side walls 206 and 207 on the circumferential section 204*d* of the running wheel 204. This results in the block-like shape of the running wheel block and thus permits the running wheel to project upward or downward. The intermediate pieces 209*c* have bores 223 or, in their place, hubs 224, into which hubs 225 or bores 226 engage in the side walls 206 or 207 in a fixing manner, permitting the running wheel block to be mounted in combination with the adjustment of individual parts. To allow the detachable or non-detachable attachment of the running wheel block, the intermediate pieces 209*c* are each equipped with at least one recess 227, which runs parallel to the running wheel axis 204*e*. As a result, prefabricated bolts can be used, which in turn permits an imprecise hole pattern of the counterpiece to be used without disadvantages, because the bolts can move in the recess 227 and adjust to the imprecise hole pattern. The recesses 227 can be designed as a channel guide 227*a*, as passage bores 227*b* or as threaded bores 227*c*. Channel nuts 228 for connecting screws 229 (FIG. 10*b*) run in the channel guides 227*a* in a cross-adjustable manner and with little play. This embodiment thus facilitates the connection and orientation between the supporting framework, carrier, travelling frame or the like and the housing of the running wheel block during initial assembly.

The intermediate pieces 209*c* are arranged substantially on the housing front sides 201*b*, which are formed together with the side wall front sides 206*b* or 207*b*. The intermediate pieces 209*c* have channel guides 227*a* and through bores 227*b* or threaded bores 227*c*, which are part of the extruded profile 209*a*. Depending on the precision of the connection, the appropriate type of passageway can be selected. To create unambiguous contact conditions for the running wheel block on the supporting framework, carrier, travelling frame 205 or the like, at least one side wall 206 or 207 is placed lower, relative to the head connecting surface 210. This also makes its possible for one side wall 206 or 207 to be detached in a simple manner from the running wheel block, without causing mis-adjustment of the entire running wheel block relative to the supporting framework, carrier, travelling frame 205 or the like. In other words, this measure permits an easy removal of the side wall to be removed on one side.

At least one side wall 206 or 207 is equipped with centering means, in the form of centering hubs 206*c* or 207*c*, which engage into corresponding bores 230 of the spacing holders 209 or of an intermediate piece 209*c*, so that an advantageous transmission of force takes place.

It is also possible for the side wall hubs 225 to be equipped with inner bores 231 to hold carrying bolts 232, which run concentric to the side wall hub 225. This design contributes to a good force transmission to support the reaction forces in the housing of the running wheel block.

The centering hubs 206*c* or 207*c*, the corresponding bores 230 in the spacing holder 209 or an intermediate piece 209*c*, and the inner borings 231 run, with their common axis 233, outside of the circumferential section 204*d* of the running wheel 204 parallel to the running wheel axis 204*e*. This facilitates assembly, disassembly and adjustment.

In the spacing holder 209, on the side 209*e* opposite to the one side wall 206 or 207, there is a holding hub for a rotary bearing 203 to hold an inner ring 235 or an outer ring 236, specifically on the spacing holder 209 (not shown).

Figure 10B:
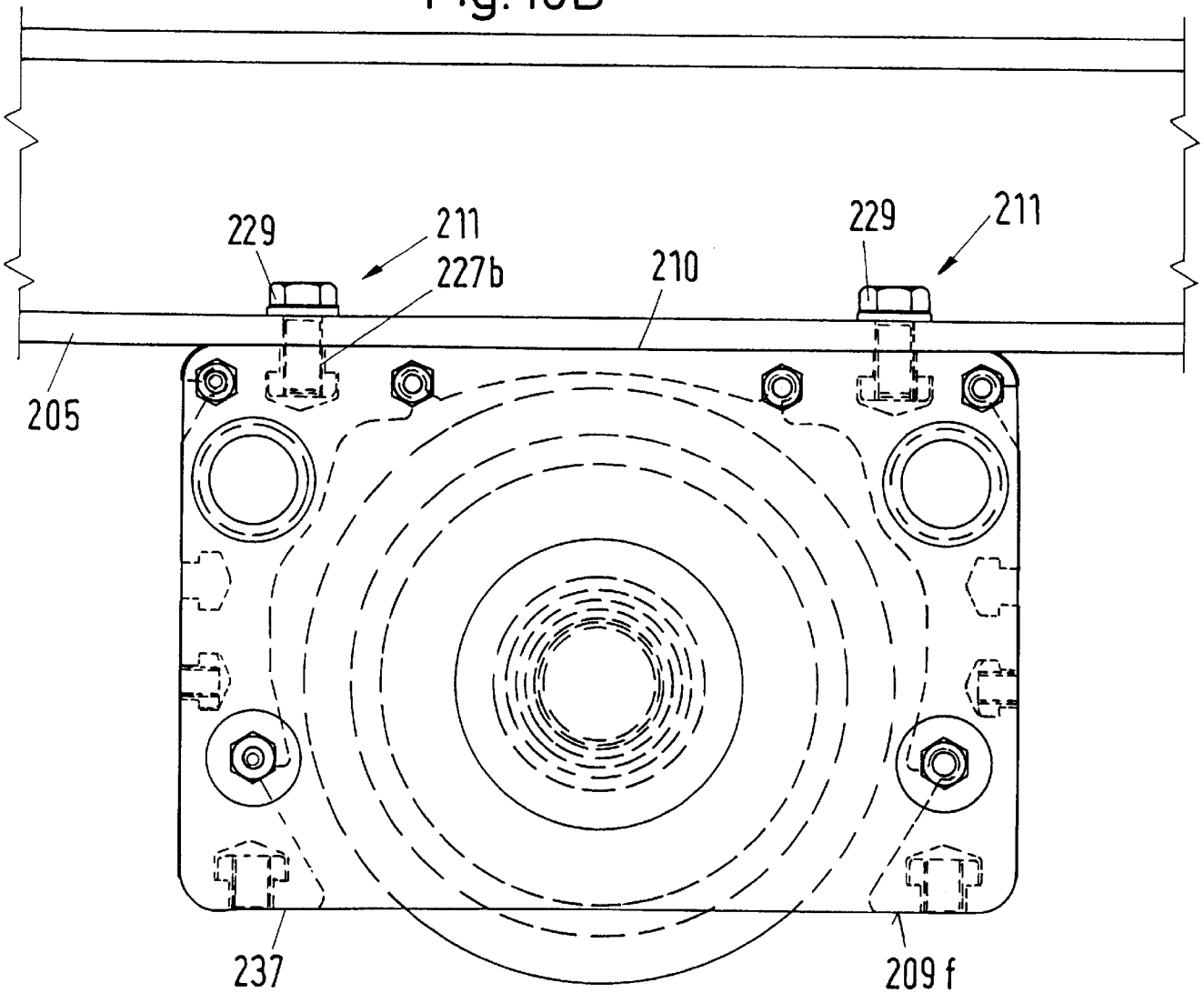

On the outer surface 209*f* opposite to the head connecting surface 210 of the spacing holder 209 or the intermediate piece 209*c*, at least one partial connecting surface 237 (pointing downward) is formed (FIG. 10*b*). The running wheel block can therefore be used even in the set-on or set-up position. The outer front connecting surfaces 209*d* of the spacing holder or spacing holders 209 are undivided and form respective absorbing surfaces for carrying forces.

Figure 5B:
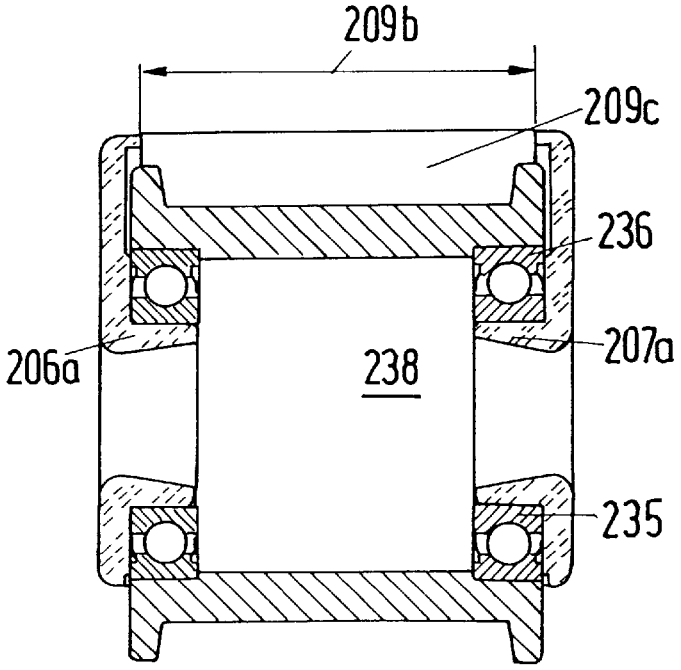
FIG. 5B is the same cross-section as in FIGS. 3B and 4B, of a further embodiment.
Figure 6B:
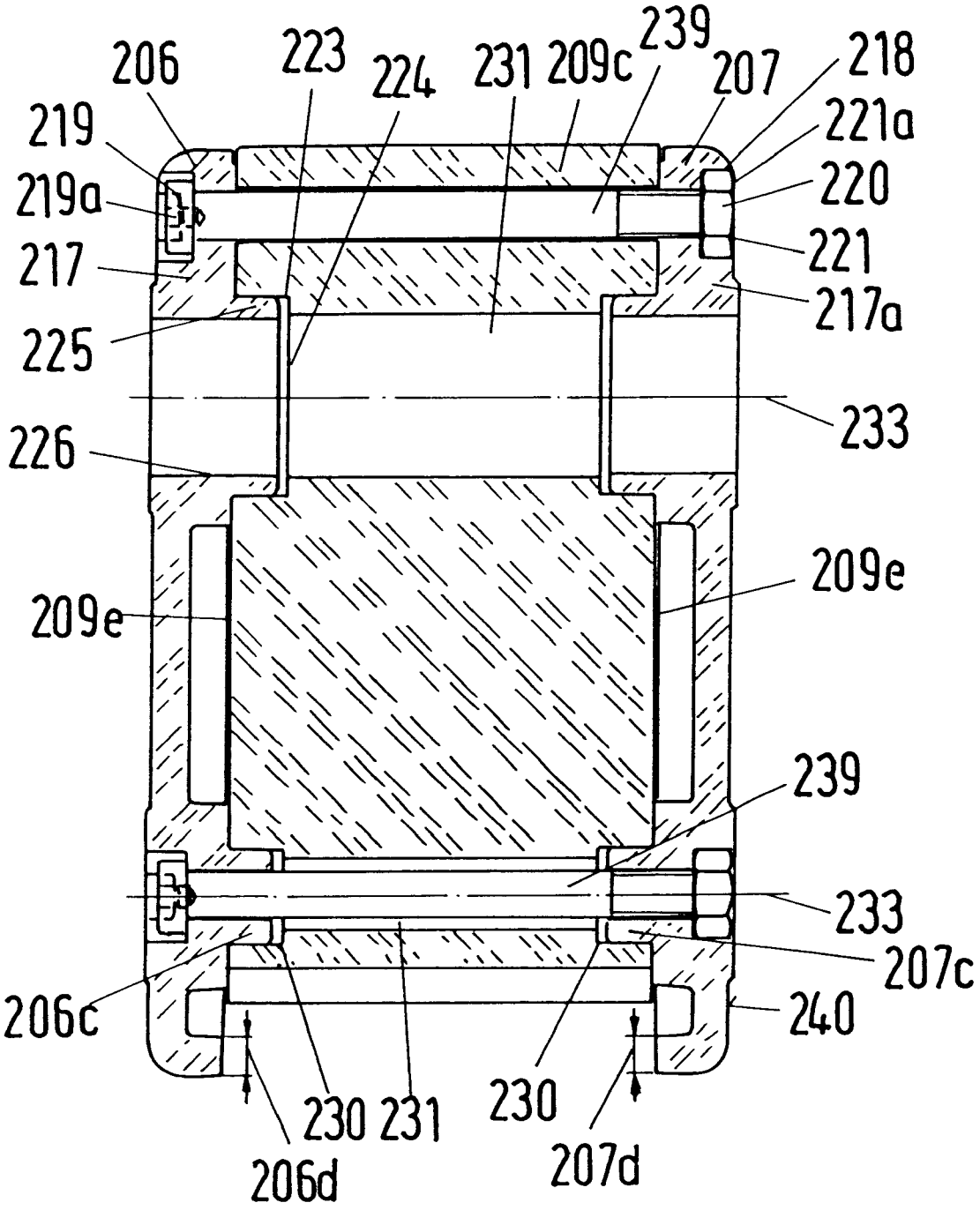
FIG. 6B is a cross-section through the running wheel block on one plane of a spacing holder.
Figure 7B:
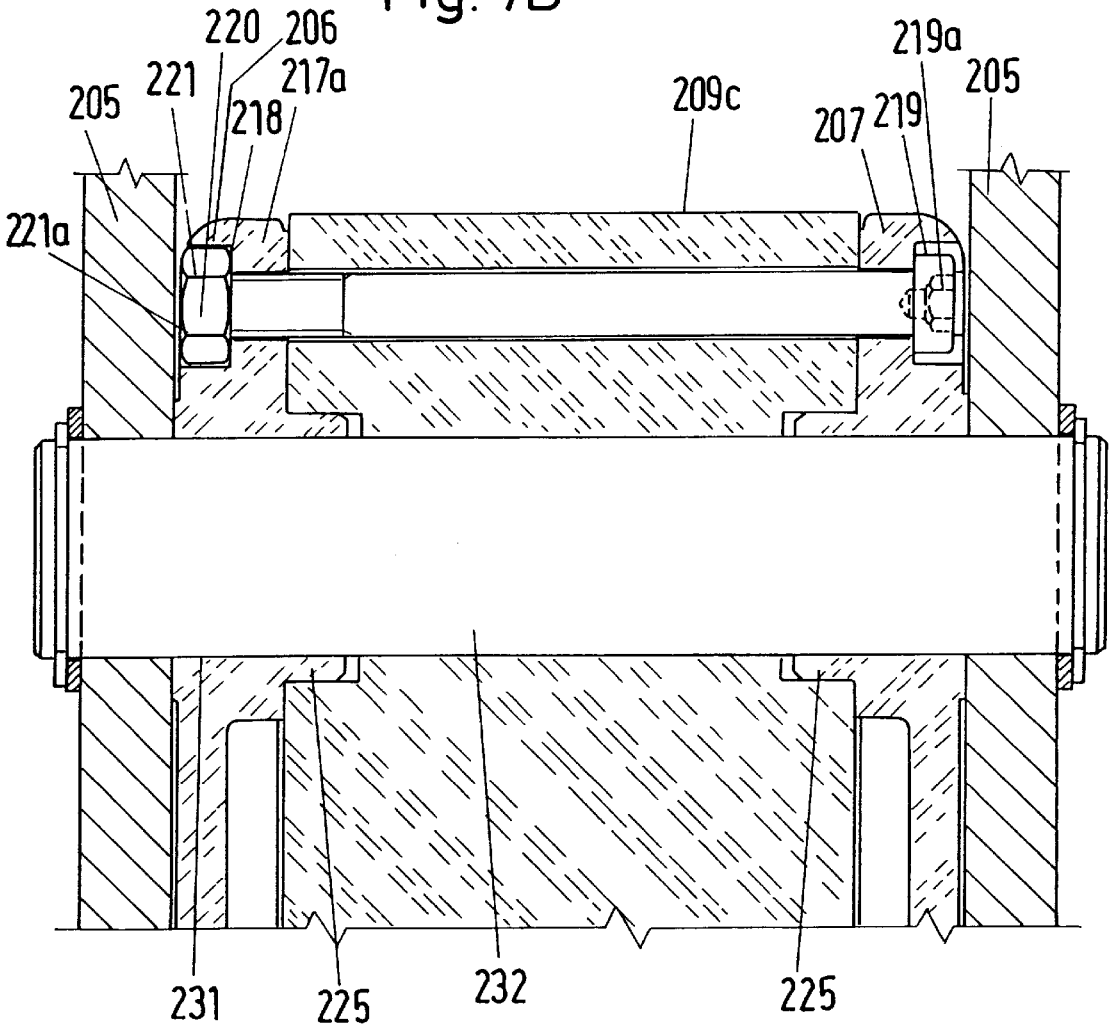
FIG. 7B is a cross-section through the attachment of the running wheel block on a supporting framework by means of carrying bolts.
Figure 9B:
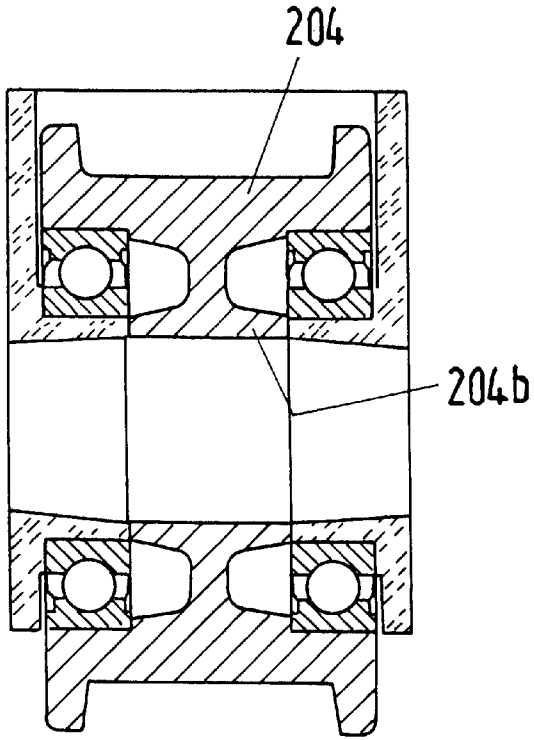
FIG. 9B is a center cross-section as in FIG. 8B.
Figure 8B:
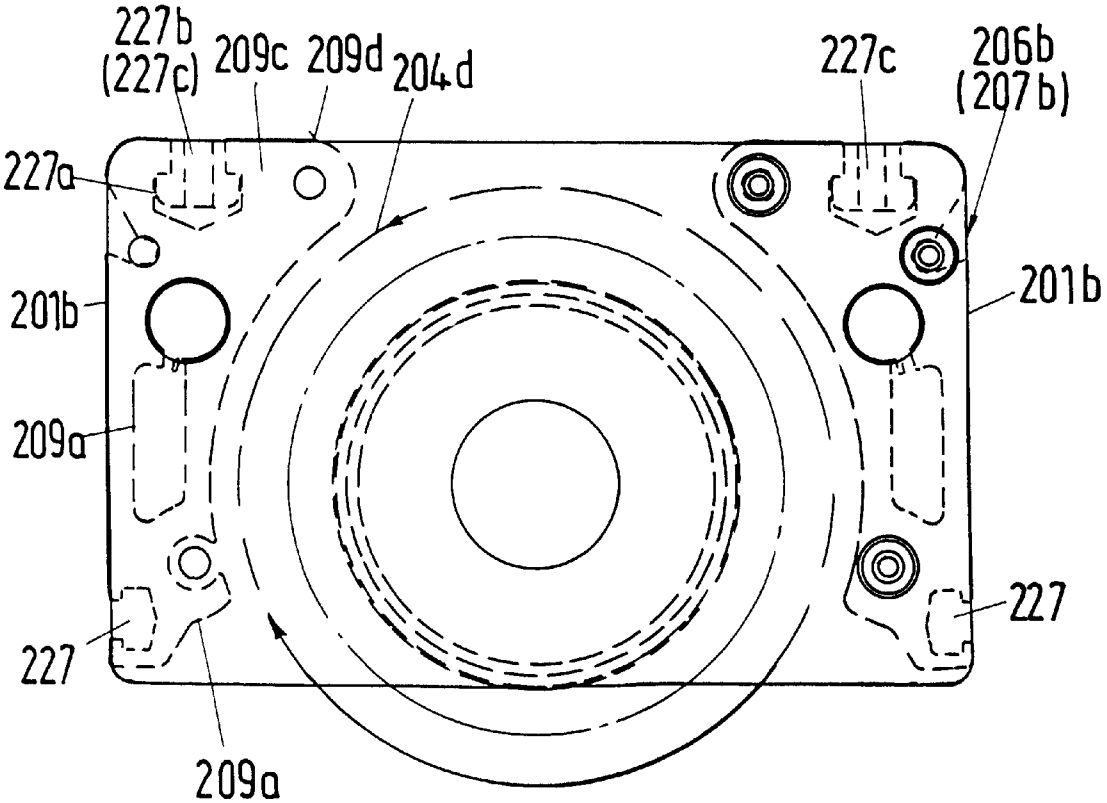
FIG. 8B is a side view as in FIGS. 1B and 2B with displaced connecting means.

The side walls 206 and 207 are made of steel sheet, whereby the sheet thickness 206*d* or 207*d* is bent inward around the running wheel 204 to the wheel block center 238 (FIGS. 5B and 6B). This is a production method for the essential parts of the running wheel block.

The screw heads 219, the nuts 220 and the sinks 218 for attachment bolts 239 lie below standing-back surfaces 240, and thus stand back behind the outer contour of the running wheel block. The running wheel block is held together in this manner. To avoid corrosion and to save weight, the spacing holders 209 or the intermediate pieces 209*c* and/or the side walls 206 or 207 are made of material processed in a molten state. The material can be, for example, a light metal alloy. Alternatively, however, the material can be an iron alloy. Further, the material can be a plastifiable plastic. Finally, it is possible for the material to consist of composite material or to form a composite material with other materials.

The invention is not limited by the embodiments described above which are presented as examples only but can be modified in various ways within the scope of protection defined by the appended patent claims.

We claim:

1. A running wheel block, comprising:

a housing having at least one connecting surface for connection to a supporting framework, and further having two opposing, detachable side walls;

two inwardly directed rotary bearing holding hubs arranged in the housing;

rotary bearings mounted in the hubs;

a running wheel mounted in the rotary bearings so that a section of its running surface projects from the housing toward at least one side, each of the holding hubs being arranged on one of the two opposing side walls of the housing, the housing further including at least one spacing holder arranged between the opposing side walls, the spacing holder forming a connecting surface, the detachable side walls having centering means that, when the side walls are attached to the housing, determine position of the holding hubs relative to the running wheel axis, the side walls being bilaterally arranged and the spacing holder connecting the two side walls to a circumferential section, the connecting surface being a head connecting surface that absorbs carrying force and extends to one of a width of the housing and a width of the running wheel; and means provided on the spacing holder for connecting the housing to the supporting frame, the holding hubs being configured as sidewall hubs that carry the rotary bearings, which terminate approximately with one of the width of the running wheel and a width of a running wheel hub.

2. A running wheel block as defined in claim 1, wherein two separate spacing holders are arranged in a direction of travel in front of and behind the running wheel.

3. A running wheel block as defined in claim 1, wherein two spacing holders are provided which define an opening therebetween, and further comprising a closing piece arranged to close the opening.

4. A running wheel block as defined in claim 3, wherein the spacing holders are intermediate pieces which laterally fill a space between the two side walls on a circumferential section of the running wheel.

5. A running wheel block as defined in claim 1, wherein the spacing holder is an extruded profile.

6. A running wheel block as defined in claim 1, wherein the two side wall hubs extend toward each other up to a distancing gap.

7. A running wheel block as defined in claim 1, wherein at least one of the side walls is configured to stand back at least relative to one front connecting surface.

8. A running wheel block as defined in claim 1, wherein at least one partial connecting surface is formed on an outer surface of the spacing holder opposite to the head connecting surface.

9. A running wheel block as defined in claim 1, wherein the connecting surface of the spacing holder is undivided and forms an absorbing surface for carrying forces.

10. A running wheel block as defined in claim 1, wherein at least one of the spacing holder and the side walls consist of a material that can be processed in a molten state.

11. A running wheel block as defined in claim 10, wherein the material of the at least one of the spacing holder and the side walls is a light metal alloy.

12. A running wheel block, comprising:

a housing having at least one connecting surface for connection to a supporting framework, and further having two opposing, detachable side walls;

two inwardly directed rotary bearing holding hubs arranged in the housing;

rotary bearings mounted in the hubs; and a running wheel mounted in the rotary bearings so that a section of its running surface projects from the housing toward at least one side, each of the holding hubs being arranged on one of the two opposing side walls of the housing, the housing further including at least one spacing holder arranged between the opposing side walls, the spacing holder forming a connecting surface, the detachable side walls having centering means that, when the side walls are attached to the housing, determine position of the holding hubs relative to the running wheel axis, the spacing holder having a width corresponding to a running wheel width.

13. A running wheel block, comprising:

a housing having at least one connecting surface for connection to a supporting framework, and further having two opposing, detachable side walls;

two inwardly directed rotary bearing holding hubs arranged in the housing;

rotary bearings mounted in the hubs; and a running wheel mounted in the rotary bearings so that a section of its running surface projects from the housing toward at least one side, each of the holding hubs being arranged on one of the two opposing side walls of the housing, the housing further including at least one spacing holder arranged between the opposing side walls, the spacing holder forming a connecting surface, the detachable side walls having centering means that, when the side walls are attached to the housing, determine position of the holding hubs relative to the running wheel axis, two spacing holders being provided so as to define an opening therebetween, and further comprising a closing piece arranged to close the opening, the spacing holders being intermediate pieces which laterally fill a space between the two side walls on a circumferential section of the running wheel, the intermediate pieces having one of bores and hubs, the side walls having one of hubs and bores that correspond to and engage with those in the intermediate pieces.

14. A running wheel block, comprising:

a housing having at least one connecting surface for connection to a supporting framework, and further having two opposing, detachable side walls;

two inwardly directed rotary bearing holding hubs arranged in the housing;

rotary bearings mounted in the hubs; and a running wheel mounted in the rotary bearings so that a section of its running surface projects from the housing toward at least one side, each of the holding hubs being arranged on one of the two opposing side walls of the housing, the housing further including at least one spacing holder arranged between the opposing side walls, the spacing holder forming a connecting surface, the detachable side walls having centering means that, when the side walls are attached to the housing, determine position of the holding hubs relative to the running wheel axis, two spacing holders being provided so as to define an opening therebetween, and further comprising a closing piece arranged to close the opening, the spacing holders being intermediate pieces which laterally fill a space between the two side walls on a circumferential section of the running wheel, each of the intermediate pieces having at least one recess which runs parallel to the running wheel axis.

15. A running wheel block, comprising:

a housing having at least one connecting surface for connection to a supporting framework, and further having two opposing, detachable side walls;

two inwardly directed rotary bearing holding hubs arranged in the housing;

rotary bearings mounted in the hubs; and a running wheel mounted in the rotary bearings so that a section of its running surface projects from the housing toward at least one side, each of the holding hubs being arranged on one of the two opposing side walls of the housing, the housing further including at least one spacing holder arranged between the opposing side walls, the spacing holder forming a connecting surface, the detachable side walls having centering means that, when the side walls are attached to the housing, determine position of the holding hubs relative to the running wheel axis, two spacing holders being provided so as to define an opening therebetween, and further comprising a closing piece arranged to close the opening, the spacing holders being intermediate pieces which laterally fill a space between the two side walls on a circumferential section of the running wheel, the intermediate pieces being arranged substantially on front sides of the housing which are formed together with front sides of the side walls.

16. A running wheel block, comprising:

a housing having at least one connecting surface for connection to a supporting framework, and further having two opposing, detachable side walls;

two inwardly directed rotary bearing holding hubs arranged in the housing;

rotary bearings mounted in the hubs; and a running wheel mounted in the rotary bearings so that a section of its running surface projects from the housing toward at least one side, each of the holding hubs being arranged on one of the two opposing side walls of the housing, the housing further including at least one spacing holder arranged between the opposing side walls, the spacing holder forming a connecting surface, the detachable side walls having centering means that, when the side walls are attached to the housing, determine position of the holding hubs relative to the running wheel axis, at least one of the side walls being placed lower relative to the head connecting surface.

17. A running wheel block, comprising:

a housing having at least one connecting surface for connection to a supporting framework, and further having two opposing, detachable side walls;

two inwardly directed rotary bearing holding hubs arranged in the housing;

rotary bearings mounted in the hubs; and a running wheel mounted in the rotary bearings so that a section of its running surface projects from the housing toward at least one side, each of the holding hubs being arranged on one of the two opposing side walls of the housing, the housing further including at least one spacing holder arranged between the opposing side walls, the spacing holder forming a connecting surface, the detachable side walls having centering means that, when the side walls are attached to the housing, determine position of the holding hubs relative to the running wheel axis, two spacing holders being provided so as to define an opening therebetween, and further comprising a closing piece arranged to close the opening, the spacing holders being intermediate pieces which laterally fill a space between the two side walls on a circumferential section of the running wheel, the centering means being centering hubs that engage in corresponding bores of the spacing holder.

18. A running wheel block as defined in claim 17, wherein the side wall hubs have inner bores, and further comprising carrying bolts arranged in the inner bores so as to run concentric to the side wall hubs.

19. A running wheel block as defined in claim 18, wherein the centering hubs, the corresponding bores in the spacing holders, and the inner bores run, with their common axis, outside of the circumferential section of the running wheel parallel to the running wheel axis.

20. A running wheel block, comprising:

a housing having at least one connectin surface for connection to a supporting framework, and further having two opposing, detachable side walls;

two inwardly directed rotary bearing holding hubs arranged in the housing;

rotary bearings mounted in the hubs; and a running wheel mounted in the rotary bearings so that a section of its running surface projects from the housing toward at least one side, each of the holding hubs being arranged on one of the two opposing side walls of the housing, the housing further including at least one spacing holder arranged between the opposing side walls, the spacing holder forming a connecting surface, the detachable side walls having centering means that, when the side walls are attached to the housing, determine position of the holding hubs relative to the running wheel axis, the spacing holder, on a side opposite to one of the side walls, has a holding hub for one of an inner ring and an outer ring of the rotary bearing.

* * * * *